US007227404B2

(12) United States Patent
Mayega et al.

(10) Patent No.: US 7,227,404 B2
(45) Date of Patent: Jun. 5, 2007

(54) METHOD FOR PREVENTING REGULATED SUPPLY UNDERSHOOT IN STATE RETAINED LATCHES OF A LEAKAGE CONTROLLED SYSTEM USING A LOW DROP OUT REGULATOR

(75) Inventors: Valerian Mayega, Dallas, TX (US); Baher S. Haroun, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 582 days.

(21) Appl. No.: 10/662,638

(22) Filed: Sep. 15, 2003

(65) Prior Publication Data

US 2005/0057952 A1 Mar. 17, 2005

(51) Int. Cl.
*G05F 1/10* (2006.01)
*G05F 3/02* (2006.01)

(52) U.S. Cl. ..... 327/538; 327/544; 327/546

(58) Field of Classification Search ..... None
See application file for complete search history.

(56) References Cited

U.S. PATENT DOCUMENTS

| | | | | |
|---|---|---|---|---|
| 6,166,985 | A * | 12/2000 | McDaniel et al. | 365/230.06 |
| 6,809,578 | B2 * | 10/2004 | Saitoh | 327/541 |
| 7,020,041 | B2 * | 3/2006 | Somasekhar et al. | 365/229 |
| 2004/0090256 | A1 * | 5/2004 | Cho | 327/202 |
| 2004/0108884 | A1 * | 6/2004 | Morikawa | 327/530 |
| 2004/0266092 | A1 * | 12/2004 | Aksamit | 438/222 |
| 2006/0119991 | A1 * | 6/2006 | Garg et al. | 361/18 |

* cited by examiner

*Primary Examiner*—Tuan T. Lam
(74) *Attorney, Agent, or Firm*—W. James Brady; Frederick J. Telecky, Jr.

(57) ABSTRACT

A system and method are implemented for preventing regulated supply undershoot in state retained latches of a leakage controlled system, using a voltage source depending on a reference voltage that includes a decay to resolve undesirable undershoot.

29 Claims, 2 Drawing Sheets

METHOD FOR PREVENTING REGULATED SUPPLY UNDERSHOOT IN STATE RETAINED LATCHES OF A LEAKAGE CONTROLLED SYSTEM USING A LOW DROP OUT REGULATOR

BACKGROUND OF THE INVENTION

1. Field of the Invention

This invention relates generally to state retained latches, and more particularly to a technique for preventing regulated supply undershoot in state retained latches of a leakage controlled system, using a low drop-out regulator.

2. Description of the Prior Art

Dynamic voltage and frequency scaling (DVFS) is frequently employed to reduce power consumption in state retained latches in active mode, and to reduce leakage currents in sleep mode. In sleep mode, the drain-source voltage of the retained latch transistors can be lowered to reduce the electric fields and hence reduce the leakage. The associated system/chip may however, not be completely off, and any related rudimentary logic, latch data and static random access memory (SRAM) need to retain their values. Any undershoot transient in the dynamically varied voltage therefore, may cause un-reliable state retention, and therefore is undesirable. Sense amplifier circuit techniques are known for preventing regulated supply undershoot in state retained latches of a leakage controlled system. Such techniques are disadvantageous in that they consume undesirable amounts of power, consume undesirable amounts of die are, and are often difficult to implement.

In view of the foregoing, a need exists for a technique for preventing regulated supply undershoot in state retained latches of a leakage controlled system without use of sense amplifier circuits.

SUMMARY OF THE INVENTION

To meet the above and other objectives, the present invention provides a technique for preventing regulated supply undershoot in state retained latches of a leakage controlled system, using for example, a low drop-out (LDO) regulator. A leakage control LDO is enabled in sleep mode to supply a voltage (sleep voltage) that is below the core voltage of active operation, but that is high enough to allow state retention in the SRAM and latches in the logic (System). To prevent an undershoot during the transient settling of the LDO, the voltage reference input of the regulator (which is also at the sleep voltage in sleep mode) is pre-charged with a switch to the higher core voltage when the System is in active mode. A capacitor from the reference pin of the LDO to ground is used to store the charge and add a time constant. Hence, the output voltage of the LDO is at the core voltage because the reference is at the core. When the System enters sleep mode, the LDO is enabled. Because of the capacitor at the LDO input reference pin, there is a slow discharge to the desired sleep voltage of the reference pin. During that slow discharge, the output of the LDO goes through its transient phase, undershoots at a voltage higher than the sleep voltage and hence reliable retention voltage, and then settles to the discharging reference voltage value. As the reference voltage slowly reaches its sleep voltage value, so does the output of the LDO. This occurs smoothly and without undershoot.

Any voltage source (linear or switched, etc.), including an LDO, can be used to implement the invention, so long as the voltage source depends on a reference voltage including a decay to resolve the undesirable undershoot.

According to one embodiment, a method for preventing regulated supply undershoot in state retained latches of a leakage controlled system comprises the steps of:

providing a leakage control voltage source configured to supply a sleep voltage level below an active operation core voltage level and above a predetermined minimum level during a sleep mode, such that the sleep voltage is high enough to allow logic device state retention in the leakage controlled system; and biasing the voltage source via a reference voltage, wherein the reference voltage is provided via a charge storage device that is pre-charged to the active operation core voltage level when the system is in its active mode, such that when the system enters it sleep mode, the reference voltage slowly discharges to the sleep voltage level, and further such that when the system enters its sleep mode, the output of the voltage source goes through its transient phase and undershoots at a voltage level higher than the sleep voltage before finally settling to the sleep voltage level.

According to another embodiment, a method for preventing regulated supply undershoot in state retained latches of a leakage controlled system comprises the steps of:

providing means for supplying a sleep voltage level below an active operation core voltage level and above a predetermined minimum level during a sleep mode, such that the sleep voltage is high enough to allow logic device state retention in the leakage controlled system; and biasing the sleep voltage level supplying means via a reference voltage provided by a charge storage device that is pre-charged to the active operation core voltage level when the system is in its active mode, such that when the system enters its sleep mode, the reference voltage slowly discharges to the sleep voltage level, and further such that when the system enters its sleep mode, the output of the sleep voltage level supplying means goes through its transient phase and undershoots at a voltage level higher than the sleep voltage before finally settling to the sleep voltage level.

According to yet another embodiment, a leakage control voltage source is configured to prevent regulated supply undershoot in a leakage controlled system and to supply a sleep voltage level below an active operation core voltage level and above a predetermined minimum level during a sleep mode, such that the sleep voltage is high enough to allow logic device state retention in the leakage controlled system.

According to still another embodiment, a leakage control voltage source is operational in response to a reference voltage to prevent undesirable regulated supply undershoot in a leakage controlled system and to supply a sleep voltage level below an active operation core voltage level and above a predetermined minimum level during a sleep mode, such that the sleep voltage is high enough to allow logic device state retention in the leakage controlled system.

BRIEF DESCRIPTION OF THE DRAWINGS

Other aspects and features of the present invention and many of the attendant advantages of the present invention will be readily appreciated as the invention becomes better understood by reference to the following detailed description when considered in connection with the accompanying drawings in which like reference numerals designate like parts throughout the figures thereof and wherein.

While the above-identified drawing figures set forth particular embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
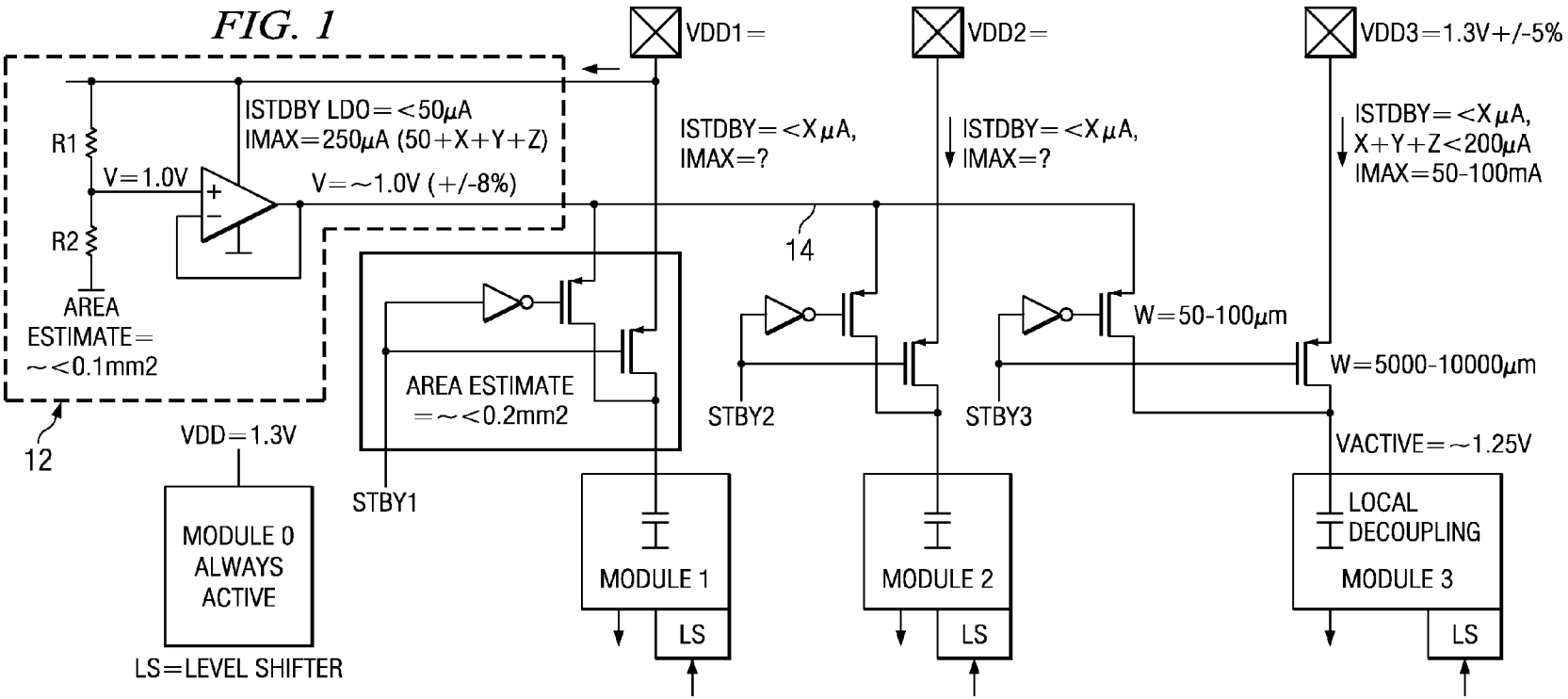
FIG. 1 is a schematic diagram illustrating a circuit for preventing regulated supply undershoot in state retained latches of a leakage controlled digital base band system using a low drop-out regulator.

Looking now at FIG. 1, a schematic diagram illustrates a circuit for preventing regulated supply undershoot in state retained latches of a leakage controlled digital base band (DBB) system 10 using a low drop-out (LDO) regulator 12. A leakage control LDO 12 is enable in sleep mode to supply a voltage (sleep mode) 14 that is below the core voltage of active operation, but is high enough to allow state retention in the SRAM and latches in logic (DBB system 10). The low voltage 14 reduces the electric field across the drain-source junctions of the transistors inside modules 1, 2 and 3 shown in FIG. 1, effectively reducing leakage. These transistors could be shown as, for example, but not limited to, simple pmos/nmos inverters in parallel with the capacitors depicted within modules 1, 2 and 3 to implement switches that connect/disconnect the LDO 12 when the system 10 transitions from SLEEP to ACTIVE respectively. The low voltage 14 however, must not dip below a determined value; otherwise the data retention may not be reliable.

Figure 2:
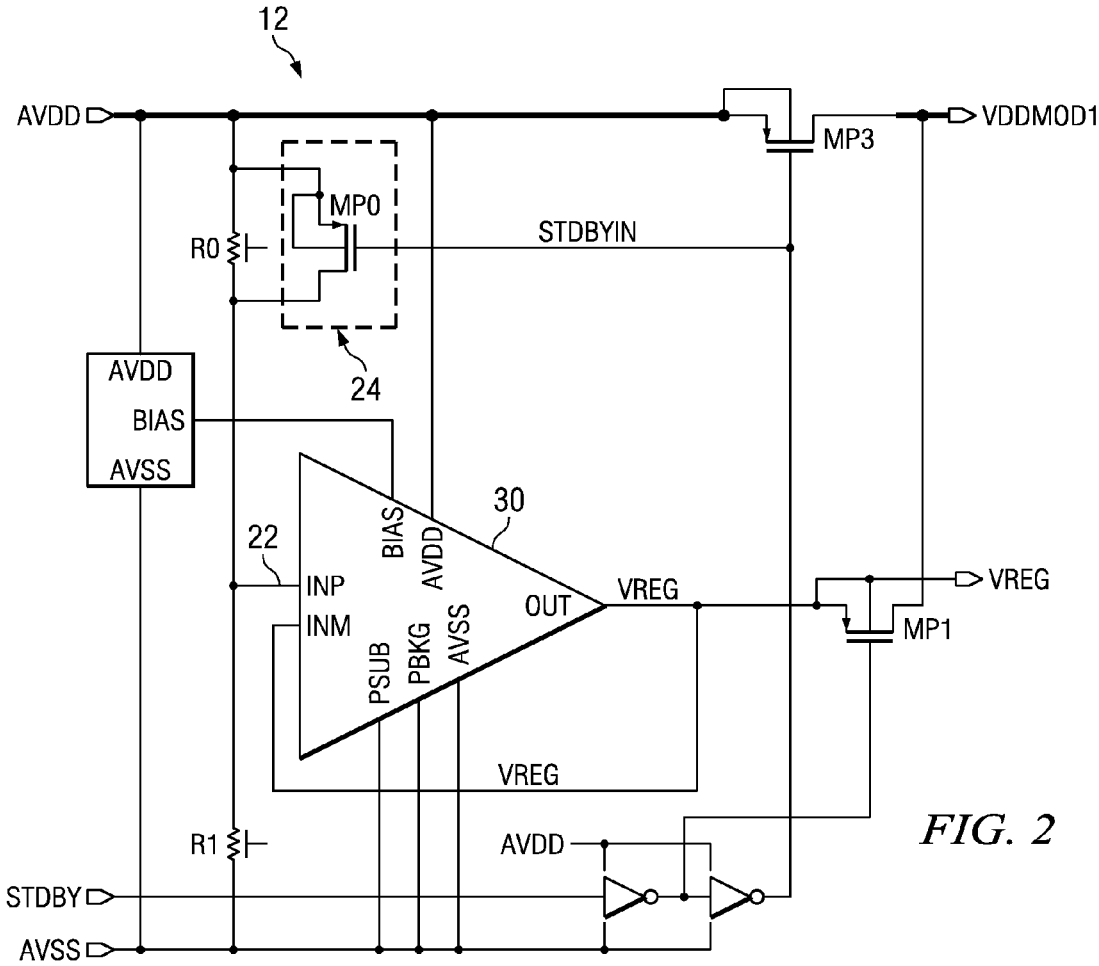
FIG. 2 is a more detailed schematic diagram illustrating the low drop-out circuit shown in FIG. 1.

Moving now to FIG. 2, a more detailed schematic diagram illustrates the low drop-out regulator 12 shown in FIG. 1. The voltage reference input 22 of the regulator 12 (which is also at the sleep voltage 14 in sleep mode) is pre-charged with a switch 24 to the higher core voltage when the DBB system 10 is in active mode in order to prevent an undershoot during the transient settling of the LDO 12.

Figure 3:
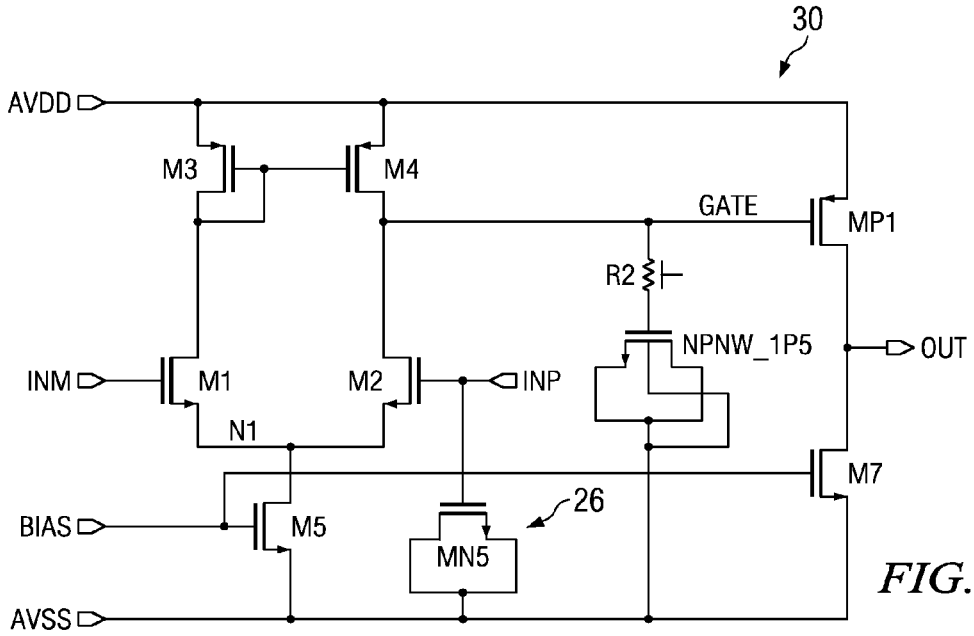
FIG. 3 is a more detailed schematic diagram illustrating the regulator shown in FIG. 2.

FIG. 3 is a more detailed schematic diagram illustrating the regulator error amplifier 30 shown in FIG. 2. A capacitor 26 from the reference pin of the LDO 12 to ground is used to store the charge and add a time constant. Therefore, the output voltage 14 of the LDO 12 shown in FIGS. 1-2 is at the core voltage because the reference input 22 is at the core voltage. When the DBB system 10 enters the sleep mode, the LDO 12 is enabled. Because of the capacitor 26 at the LDO 12 input reference pin 22, there is a slow discharge to the desired sleep voltage of the reference pin 22. During that slow discharge, the output of the LDO 12 goes through its transient phase, undershoots at a voltage higher than the sleep voltage and hence reliable retention voltage, and then settles to the discharging reference voltage. As the reference voltage slowly reaches its sleep voltage value, so does the output of the LDO 12. This occurs smoothly and without undershoot.

Figure 4:
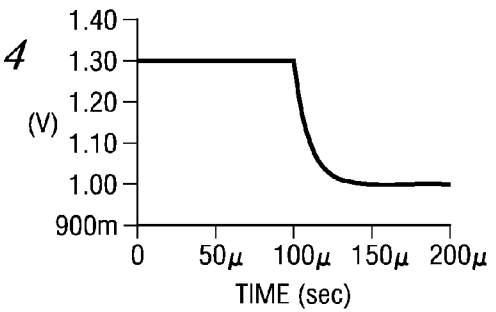
FIG. 4 is a waveform diagram illustrating DC simulation results of the undershoot control system depicted in FIGS. 1-3.

FIG. 4 is a transient response waveform diagram illustrating DC simulation results of the undershoot control system depicted in FIGS. 1-3.

In view of the above, it can be seen the present invention presents a significant advancement in the art of preventing regulated supply undershoot. Further, this invention has been described in considerable detail in order to provide those skilled in the low drop-out regulator art with the information needed to apply the novel principles and to construct and use such specialized components as are required. In view of the foregoing descriptions, it should further be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow. For example, although various embodiments have been presented herein with reference to particular transistor types, the present inventive structures and characteristics are not necessarily limited to particular transistor types or sets of characteristics as used herein. It shall be understood the embodiments described herein above can easily be implemented using many diverse transistor types so long as the combinations achieve prevention of regulated supply undershoot, according to the inventive principles set forth herein above.

What is claimed is:

1. A method for preventing regulated supply undershoot in state retained latches of a leakage controlled system, the method comprising the steps of:

providing a leakage control voltage source configured to supply a sleep voltage level below an active operation core voltage level and above a predetermined minimum level during a sleep mode, such that the sleep voltage is high enough to allow logic device state retention in the leakage controlled system; and biasing the voltage source via a reference voltage, wherein the reference voltage is provided via a charge storage device that is pre-charged to the active operation core voltage level when the system is in its active mode, such that when the system enters its sleep mode, the reference voltage slowly decays to the sleep voltage level, and further such that when the system enters its sleep mode, the output of the voltage source goes through its transient phase and undershoots at a voltage level higher than the sleep voltage before finally settling to the sleep voltage level.

2. The method according to claim 1, wherein the step of providing a reference voltage via a charge storage device comprises pre-charging a capacitor to the active operation core voltage level via a pre-charge switch.

3. The method according to claim 1, wherein the voltage source comprises a low drop-out regulator.

4. The method according to claim 1, wherein the voltage source comprises a linear regulator.

5. The method according to claim 1, wherein the voltage source comprises a switched regulator.

6. A method for preventing regulated supply undershoot in state retained latches of a leakage controlled system, the method comprising the steps of:

providing means for supplying a sleep voltage level below an active operation core voltage level and above a predetermined minimum level during a sleep mode, such that the sleep voltage is high enough to allow logic device state retention in the leakage controlled system; and biasing the sleep voltage level supplying means via a reference voltage provided by a charge storage device that is pre-charged to the active operation core voltage level when the system is in its active mode, such that when the system enters its sleep mode, the reference voltage slowly decays to the sleep voltage level, and further such that when the system enters its sleep mode, the output of the sleep voltage level supplying means goes through its transient phase and undershoots at a voltage level higher than the sleep voltage before finally settling to the sleep voltage level.

7. The method according to claim 6, wherein the step of biasing the sleep voltage level supplying means via a reference voltage provided by a charge storage device comprises pre-charging a capacitor to the active operation core voltage level via a pre-charge switch.

8. The method according to claim 6, wherein the means for supplying a sleep voltage level below an active operation core voltage level and above a predetermined minimum level during a sleep mode, such that the sleep voltage is high enough to allow logic device state retention in the leakage controlled system, comprises a leakage control low drop-out regulator.

9. The method according to claim 6, wherein the means for supplying a sleep voltage level below an active operation core voltage level and above a predetermined minimum level during a sleep mode, such that the sleep voltage is high enough to allow logic device state retention in the leakage controlled system, comprises a leakage control voltage source.

10. The method according to claim 9, wherein the voltage source comprises a low drop-out regulator.

11. The method according to claim 9, wherein the voltage source comprises a linear regulator.

12. The method according to claim 9, wherein the voltage source comprises a switched regulator.

13. A leakage control voltage source comprising a circuit to prevent regulated supply undershoot in a leakage controlled system and to supply a sleep voltage level below an active operation core voltage level and above a predetermined minimum level during a sleep mode, such that the sleep voltage is high enough to allow logic device state retention in the leakage controlled system; and when the leakage controlled system is operable to enter the sleep mode, the active operation core voltage level slowly decays to the sleep voltage level.

14. The leakage control voltage source according to claim 13, further comprising a charge storage device that is pre-charged to the active operation core voltage level when a leakage controlled system is in its active mode, such that when the system enters it sleep mode, the charge storage device slowly discharges to the sleep voltage level, and the circuit further operable such that when the system enters it sleep mode, the output of the voltage source goes through its transient phase and undershoots at a voltage level higher than the sleep voltage before finally settling to the sleep voltage level.

15. The leakage control voltage source according to claim 13, further comprising a pre-charge switch configured to transfer a pre-charge to a charge storage device.

16. The leakage control voltage source according to claim 13, further comprising a charge storage device comprises at least one capacitor.

17. The leakage control voltage source according to claim 16, further comprising a pre-charge switch configured to transfer a pre-charge to the at least one capacitor.

18. The leakage control voltage source according to claim 13, wherein the voltage source comprises a low drop-out regulator.

19. The leakage control voltage source according to claim 13, wherein the voltage source comprises a linear regulator.

20. The leakage control voltage source according to claim 13, wherein the voltage source comprises a switched regulator.

21. A leakage control voltage source operational in response to a reference voltage to prevent undesirable regulated supply undershoot in a leakage controlled system and to supply a sleep voltage level below an active operation core voltage level and above a predetermined minimum level during a sleep mode, such that the sleep voltage is high enough to allow logic device state retention in the leakage controlled system; and wherein the reference voltage includes a decay that prevents the undesirable regulated supply undershoot.

22. The leakage control voltage source according to claim 21, further comprising a charge storage device that is pre-charged to the active operation core voltage level when the leakage controlled system is in its active mode, such that when the system enters its sleep mode, the charge storage device slowly discharges to the sleep voltage level, and further such that when the system enters its sleep mode, the output of the voltage source goes through its transient phase and undershoots at a voltage level higher than the sleep voltage before finally settling to the sleep voltage level.

23. The leakage control voltage source according to claim 21, further comprising a pre-charge switch configured to transfer a pre-charge to the charge storage device.

24. The leakage control voltage source according to claim 21, further comprising a charge storage device comprises at least one capacitor.

25. The leakage control voltage source according to claim 24, further comprising a pre-charge switch configured to transfer a pre-charge to the at least one capacitor.

26. The leakage control voltage source according to claim 21, wherein the reference voltage is generated via a low drop-out regulator.

27. The leakage control voltage source according to claim 21, wherein the reference voltage is generated via a linear regulator.

28. The leakage control voltage source according to claim 21, wherein the reference voltage is generated via a switched regulator.

29. A leakage control voltage source comprising a circuit to prevent regulated supply undershoot in a leakage controlled system and to supply a sleep voltage level below an active operation core voltage level and above a predetermined minimum level during a sleep mode, such that the sleep voltage is high enough to allow logic device state retention in the leakage controlled system; and the circuit comprising a charge storage device that is pre-charged to the active operation core voltage level when the leakage controlled system is in its active mode, such that when the system enters its sleep mode, the charge storage device slowly decays to the sleep voltage level.

* * * * *